US010001031B2

(12) United States Patent
Ollivau

(10) Patent No.: US 10,001,031 B2
(45) Date of Patent: Jun. 19, 2018

(54) TURBINE CASING AND METHOD OF MANUFACTURING THEREOF

(75) Inventor: Eric Ollivau, Roissy en France (FR)

(73) Assignee: General Electric Technology GmbH, Baden (CH)

( * ) Notice: Subject to any disclaimer, the term of this patent is extended or adjusted under 35 U.S.C. 154(b) by 1630 days.

(21) Appl. No.: 13/546,135

(22) Filed: Jul. 11, 2012

(65) Prior Publication Data

US 2013/0064651 A1 Mar. 14, 2013

(30) Foreign Application Priority Data

Jul. 19, 2011 (EP) ..... 11290328

(51) Int. Cl.
*F01D 25/24* (2006.01)

(52) U.S. Cl.
CPC ..... *F01D 25/24* (2013.01); *F05D 2220/31* (2013.01); *F05D 2230/21* (2013.01); *F05D 2230/61* (2013.01)

(58) Field of Classification Search
CPC .. F01D 25/24; F05D 2230/61; F05D 2220/31; F05D 2230/21
See application file for complete search history.

(56) References Cited

U.S. PATENT DOCUMENTS 3,640,639 A * 2/1972 Ruhl ..... 415/232
3,914,842 A * 10/1975 Bruckhoff et al. ..... 29/888
4,281,964 A * 8/1981 Jinkins ..... 415/203
4,948,331 A * 8/1990 Roy et al. ..... 415/20
7,687,021 B2 3/2010 Imbourg et al.
2005/0132707 A1* 6/2005 Gebhardt ..... 60/726
2006/0026833 A1 2/2006 Imbourg et al.
2008/0250624 A1* 10/2008 Storch et al. ..... 29/402.03

FOREIGN PATENT DOCUMENTS

| | | | |
|---|---|---|---|
| CN | 1690382 | A | 11/2005 |
| CN | 101558219 | A | 10/2009 |
| CN | 101796304 | A | 8/2010 |
| DE | 4425352 | A1 | 1/1996 |
| EP | 2243933 | A1 | 10/2010 |
| GB | 726072 | A | 3/1955 |
| RU | 2 377 422 | C2 | 12/2009 |
| SU | 79830 | A1 | 11/1949 |

OTHER PUBLICATIONS

Chinese Office Action (First Office Action) dated Jul. 2, 2014, issued by the Chinese Patent Office in corresponding Chinese Patent Application No. 201210250797.1 (14 pgs).
Office Action (Decision of Grant) dated Mar. 5, 2015, by the Russian Patent Office in corresponding Russian Patent Application No. 2012130774/06, and an English Translation of the Office Action. (11 pages).

* cited by examiner

*Primary Examiner* — Aaron R Eastman
(74) *Attorney, Agent, or Firm* — GE Global Patent Operation; Cynthia W. Flanigan

(57) ABSTRACT

A design for a casing of a large turbine is described with the casing including at least a front section, a middle section and an end section designed such that changes to the mold of the casing required to provide for a change in rotational speed to adapt the turbine to a different power grid frequency are limited to the mold for the middle section of the casing.

9 Claims, 2 Drawing Sheets

TURBINE CASING AND METHOD OF MANUFACTURING THEREOF

RELATED APPLICATION

The present application hereby claims priority under 35 U.S.C. Section 119 to European Patent application number 11290328.1, filed Jul. 19, 2011, the entire contents of which are hereby incorporated by reference.

FIELD OF THE INVENTION

The present invention relates to casing designs for large turbines, particularly steam turbines. More specifically, the invention relates to casings for steam turbines with an electric power output of more than 1000 MW and related methods of designing and manufacturing such casings.

BACKGROUND

In the following description the term "turbine" is used to refer to rotary engines having a rotating part and a stator part force coupled by a fluid medium such as water or gas. Of particular interest for the present invention are axial turbines comprising radially arranged fixed stator blades or vanes alternating with radial arrangements of moving rotor blades. Movements are generally defined herein as movements relative to a casing or housing.

The field of designing and manufacturing large turbines has been dominated by a bespoke approach to design and manufacturing. This approach makes each turbine an individual item customized for a specific power plant or operator. In order to reduce efforts and costs involved in adapting a turbine design to a new set of specifications, attempts have been made in the past to standardize at least parts of the turbine to achieve a more modular and therefore more readily changeable design.

German published patent application no. DE 44 25 352 A1 describes for example a steam turbine having a cast housing, which is constructed as a standard casing to cover a number of different variants. The standard casing according to the DE '352 patent application has several extraction ports, which can be selectively opened according to a given turbine variant. After the casting of the standard housing all extraction ports are closed. For the selective opening of the extraction ports part of the wall are drilled out to form the ports as required.

The casings of large turbines are typically manufactured as two separate parts, i.e., a bottom and a top half. These halves are bolted together on site after the inner parts of the turbine such as the rotor, moving and stationary blades or diaphragms, seals etc. have been put in place. Though split, each half of the casing can still weigh 100 tons or more.

Given the complexity and the costs involved in casting a casing for a turbine, particularly for a large steam turbine, it is seen as an object of the present invention to provide turbine casings, designs of turbine casings and methods of manufacturing casings which reduce the amount of changes required when moving from one set of specifications to another. A particular problem the present invention addresses is the change required to adapt a given type of turbine to different frequencies of the electric power grid and hence to different rotational speeds.

SUMMARY

The present disclosure is directed to a casing for a large turbine configured to provide power to a public power grid.

The casing includes at least a front section, a middle section and an end section configured such that changes to a mold of the casing required to provide for a change in rotational speed to adapt the turbine to a different power grid frequency are limited to a mold for the middle section of the casing.

The disclosure is also directed to a mold for a casing for a turbine configured to provide power to a public power grid. The mold includes at least a front section, a middle section and an end section to be assembled prior to a casting process. The front section, the middle section and the end section are configured such that changes to the mold of the casing, required to provide for a change in rotational speed to adapt the turbine to a different power grid frequency, are limited to the mold for the middle section of the casing.

The present disclosure is further directed to a method of manufacturing a casing for a large turbine configured to provide power to a public power grid. The method includes designing the turbine casing to include at least a front section, a middle section and an end section. The method also includes limiting changes to the mold of the casing, required to provide for a change in rotational speed to adapt the turbine to a different power grid frequency, to the mold for the middle section of the casing

BRIEF DESCRIPTION OF THE DRAWINGS

Exemplary embodiments of the invention will now be described, with reference to the accompanying drawings, in which.

DETAILED DESCRIPTION OF THE PREFERRED EMBODIMENTS

Introduction to the Embodiments

According to an aspect of the present invention, there is provided a design for a casing of a large turbine with the casing including at least a front section, a middle section and an end section designed such that changes to the mold of the casing required to provide for a change in rotational speed to adapt the turbine to a different power grid frequency are limited to the mold for the middle section of the casing.

In a preferred variant, the middle section varies in the number of diaphragm supports, the number of openings or both while the molds for the front and end remain unchanged In a further preferred embodiment of the invention, the large turbine casing includes a high pressure casing part adapted to receive a high pressure turbine and an intermediate pressure casing part designed to receive an intermediate pressure turbine receiving steam which passed through the high pressure turbine.

Thus, the casing is preferably a combined high-pressure (HP) and intermediate pressure (IP) casing for housing an HP and an IP turbine within the single casing.

Both parts are balanced to reduce the resulting force on the bearings of the turbine rotor when steam passes through the turbine. In this embodiment the intermediate pressure part is integrated into the rear end of the mold and hence remains unchanged when adapting the design to a change in rotational speed or different power grid frequency, specifically for a change between a 50 Hz grid frequency and a 60 Hz frequency.

The turbine casing of the invention has preferably dimensions sufficient to accommodate a large flow of (saturated) wet steam at low temperatures and low pressures. In particular, the turbine casing is of a size sufficient to accommodate a flow of (saturated) wet steam above 5000 tons per hour, more preferably above 8000 tons/h, at low temperatures below 350 degrees Celsius, more preferably below 300 degrees Celsius, at pressures below 100 bar. The exhaust or discharge pressure at the exhaust ducts of the casing are preferably below 10 bar.

Any changes to the molds and parts of the mold are directly mirrored by changes to the casing produced using such a mold. Therefore any claim to a specific form of mold herein extends to the casing manufactured using such mould and any method of manufacturing or casting of a casing using such molds.

These and further aspects of the invention will be apparent from the following detailed description and drawings as listed below.

DETAILED DESCRIPTION

Aspects and details of examples of the present invention are described in further details in the following description using the example of a turbine housing or casing for turbines adapted for use in a 50 Hz and 60 Hz power grid, respectively.

Figure 1A:
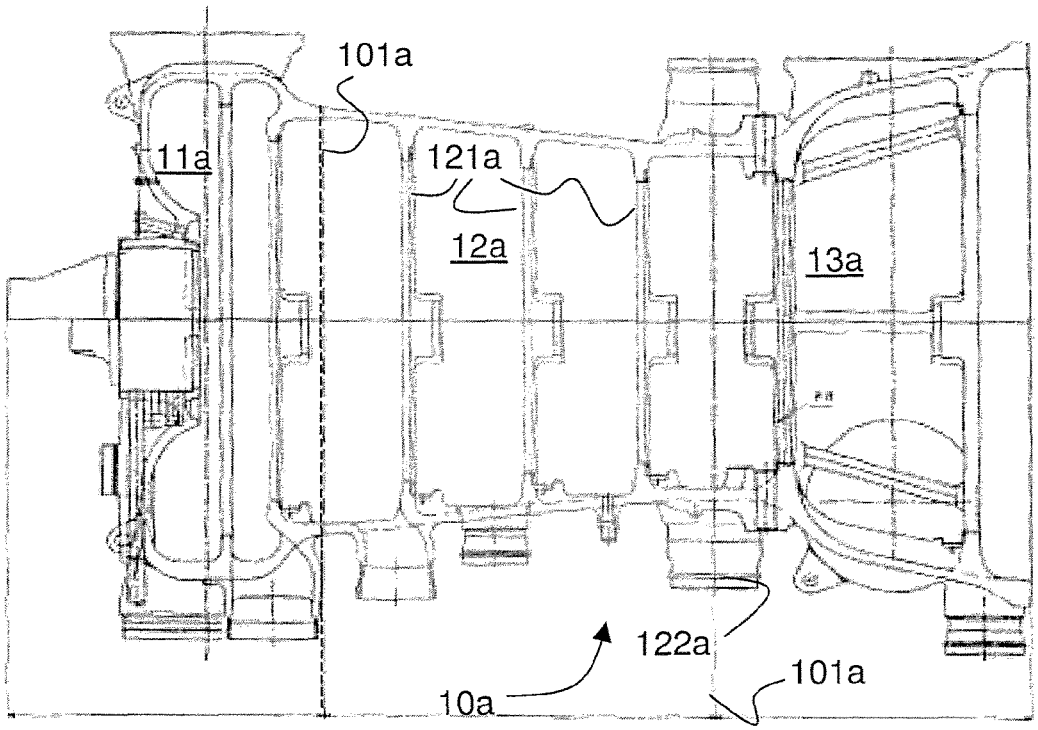
FIGS. 1A and 1B show a vertical cross-sectional view of two casings for two different grid standards showing upper and lower halves.
Figure 1B:
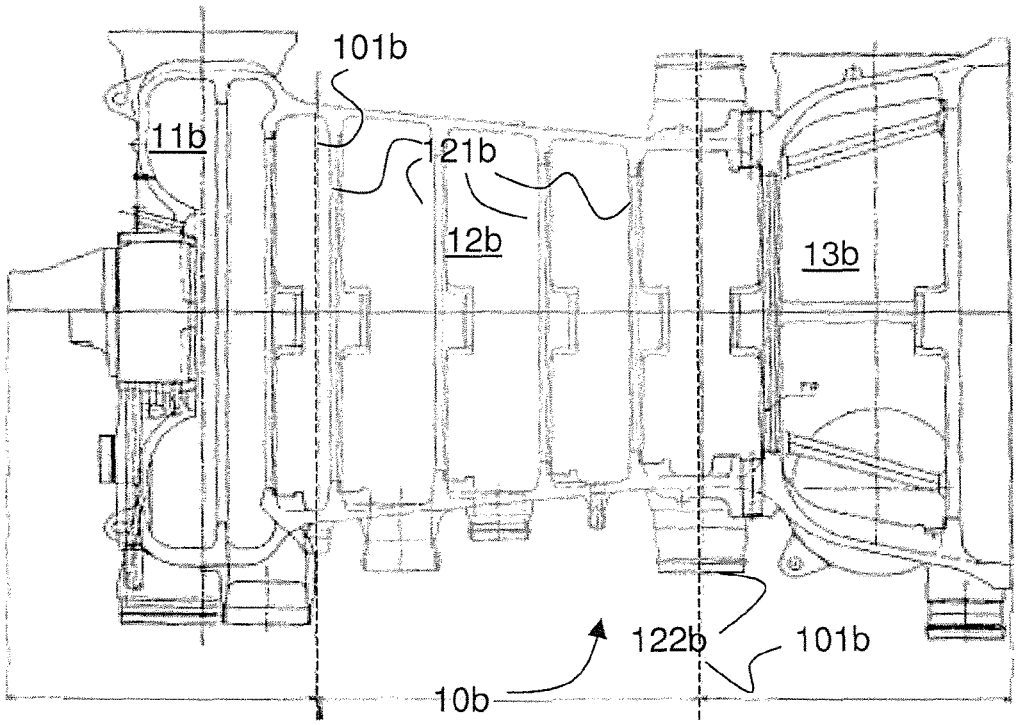

Shown in FIGS. 1A and 1B are vertical cross-sections through the casings of a turbine designed for the two different standards. In FIG. 1A, the casing is adapted to enclose a combination of an HP and an IP turbine and to be coupled to a generator for a 50 Hz power and FIG. 1B shows the corresponding casing for a 60 Hz power grid.

The casing 10*a* of FIG. 1A has three mains sections, the limits of which are indicated in the drawing by lines 101*a*. The front section 11*a* caps the high pressure (HP) turbine and includes ducts to guide the steam from the last stage of the HP turbine to either a reheater or directly into the intermediate pressure (IP) turbine. The middle section 12*a* is the casing for the HP turbine and includes support structures 121*a* for three turbine stages. It also includes part of the inlet ducts 122*a* for the live steam. A third, end section 13*a* includes the remaining part of the inlet ducts 122*a* for the live steam and the support structures (not fully shown) for the IP turbine and further ducts to guide steam into the IP turbine and exhaust ducts. The exhaust ducts guide the steam out of the casing to further turbines operating at lower steam pressures.

The casing is built as a single casing for a combined HP and IP turbine for a high mass flow of saturated (wet) steam. Under normal operating conditions the combined HP/IP turbines and their casing allow for a through flow of more than 9000 tons of wet steam per hour at 290 degrees Celsius with a pressure of 75 bar at the inlet ducts and about 3 bar at the outlet or exhaust ducts.

The casing 10*b* of FIG. 1B has equally three mains sections, the limits of which are indicated in the drawing by lines 101*b*. The front section 11*b* caps the high pressure (HP) turbine and includes ducts to guide the steam from the last stage of the HP turbine to either a reheater or directly into the intermediate pressure (IP) turbine. The middle section 12*b* is the casing for the HP turbine and includes support structures 121*b* for four turbine stages. It also includes part of the inlet ducts 122*b* for the live steam. A third, end section 13*b* includes the remaining part of the inlet ducts 122*b* for the live steam and the support structures for the IP turbine (not fully shown) and further ducts to guide steam into the IP turbine and exhaust ducts. The exhaust ducts guide the steam out of the casing to further turbines operating at lower steam pressures.

Figure 2A:
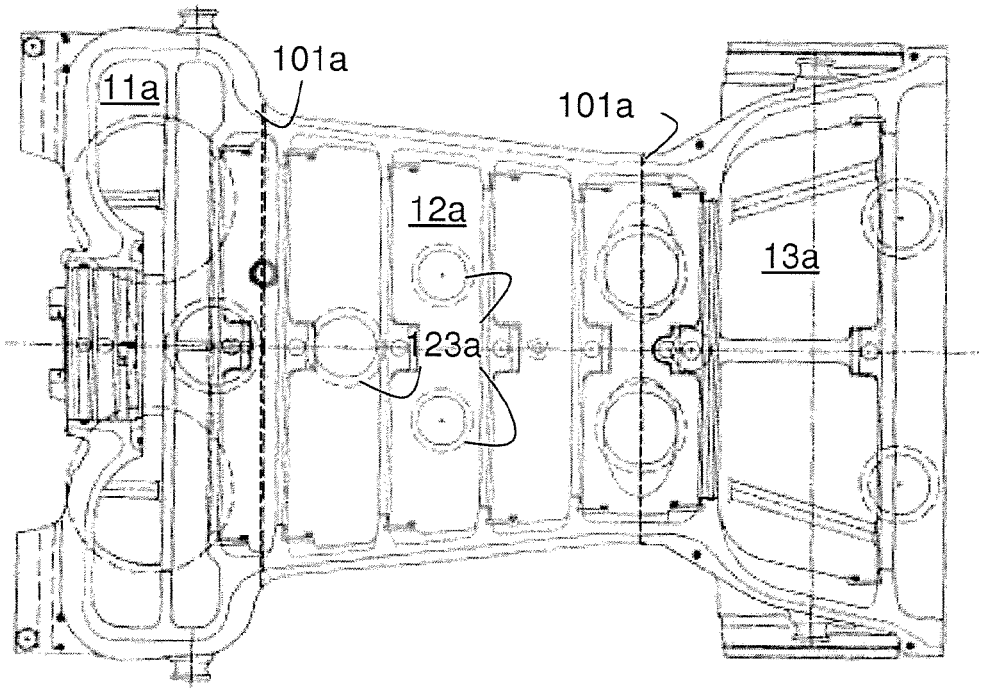
FIGS. 2A and 2B show the lower halves of casings for two different grid standards, viewed from the horizontal joint line.
Figure 2B:
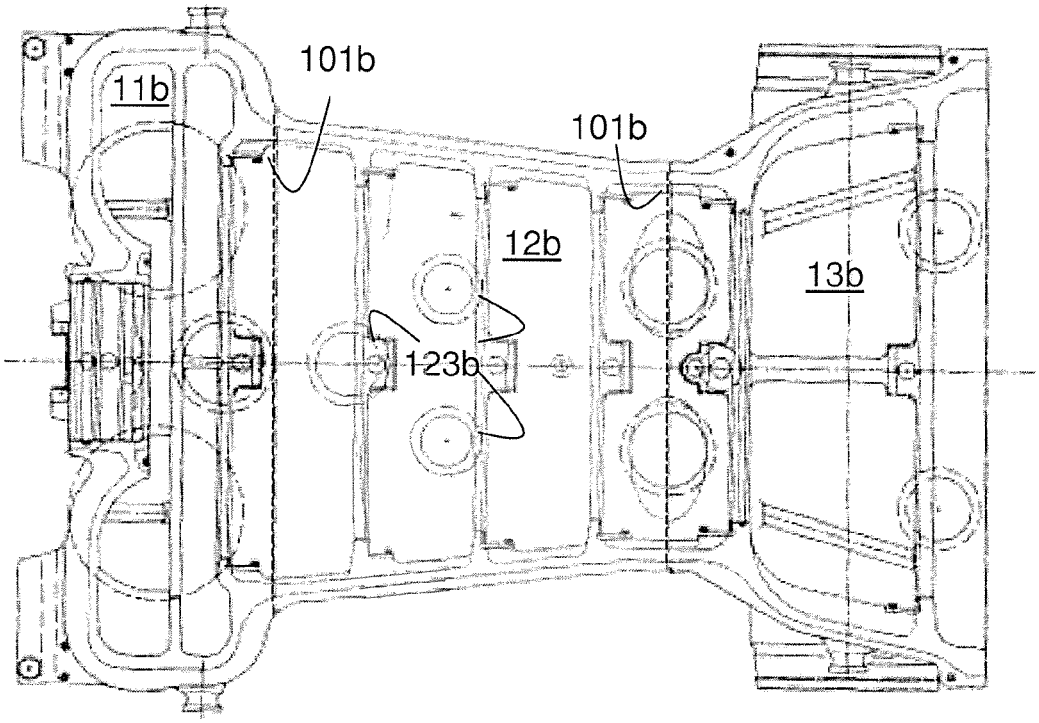

The casings of FIG. 1A and FIG. 1B are shown in a different view in FIGS. 2B and 2A, respectively. In FIGS. 2A and 2B the casings are shown represented by a horizontal cross-sectional view on the bottom half of the casing from the plane where bottom and top halves are joined when fully assembled. In this view the relative locations of holes for steam extraction 123*a*, 123*b* in the middle sections 12*a*, 12*b* are more clearly visible.

The differences between the casing of FIGS. 1A and 2B and the casing of FIGS. 1B and 2A, respectively, are limited to the middle sections 12*a*, 12*b*. Specifically, the casing of FIGS. 1B and 2A has an additional support 121*b* for a fourth stage. Furthermore, the location of the steam extraction ports 123*a*, 123*b* is changed between the two variants of the casing.

In other examples of the invention there can be fewer or more changes when moving between designs, for example by adding more or reducing the number of steam extraction ports or drain holes. However it is important to note that any such changes occur at the middle section leaving the front and end sections and their respective molds unchanged.

In the final turbine more changes can be introduced by welding or mechanically connecting further parts or by drilling further openings into the casing. Such changes are regarded as changes made after the casting and hence not considered as changes within the scope of the present invention which relates to the design and manufacturing of the casing prior to the actual casting.

The improvement provided by the new invention facilitates the casting of turbine housing when moving between different turbine designs adapted to different grid standards and their operational parameters such as rotational speed. By limiting the change to one section of the mold, all other sections can be reused and hence the new methods and casings enable an accelerated model building for the cast and this reducing the costs and time of manufacturing a turbine to different standards.

The present invention has been described above purely by way of example, and modifications can be made within the scope of the invention. For example the exact location of the split between the sections of the casing are subject to design considerations and can vary to facilitate for example the model building or the casting process.

The invention also consists in any individual features described or implicit herein or shown or implicit in the drawings or any combination of any such features or any generalization of any such features or combination, which extends to equivalents thereof. Thus, the breadth and scope of the present invention should not be limited by any of the above-described exemplary embodiments. Each feature disclosed in the specification, including the drawings, may be replaced by alternative features serving the same, equivalent or similar purposes, unless expressly stated otherwise.

Unless explicitly stated herein, any discussion of the prior art throughout the specification is not an admission that such prior art is widely known or forms part of the common general knowledge in the field.

LIST OF REFERENCE SIGNS AND NUMERALS casing 10*a*, 10*b*
separation lines 101*a*, 101*b* front section 11*a*, 11*b*
middle section 12*a*, 12*b*
support structures for turbine stages 121*a*, 121*b*
steam inlet ducts 122*a*, 122*b*
end section 13*a*, 13*b*
steam extraction ports 123*a*, 123*b*

The invention claimed is:

1. A casing for a turbine configured to provide power to a public power grid, the casing comprising:

a front section;

a middle section; and an end section wherein the front section, middle section, and end section being cast together to form the casing, and the front section and the end section are configured to be usable in turbines using a plurality of rotational speeds and the middle section is configured to form a turbine for a predetermined rotational speed to adapt the turbine to a different power grid frequency.

2. The casing of claim 1, wherein the turbine is a combined high pressure and intermediate pressure turbine within a single casing with the casing part housing the intermediate pressure turbine being the end section.

3. The casing of claim 1, wherein the middle section includes a number of support structures for stages.

4. The casing of claim 1, wherein the middle section includes a number of ducts for steam extraction or drainage.

5. The casing of claim 1, further comprising inlet ducts and outlet ducts to accommodate steam flow of more than 5000 tons/h.

6. The casing of claim 1, further comprising inlet ducts to receive wet steam at pressures below 100 bar and outlet ducts to discharge steam at pressures below 10 bar.

7. The casing of claim 1, further comprising inlet ducts to receive wet steam at temperatures below 350 degrees Celsius.

8. A mold for a casing for a turbine configured to provide power to a public power grid, the mold comprising:

a front section;

a middle section; and an end section;

the front section, the middle section, and the end section being assembled prior to a casting process, wherein the front section, and the end section are configured to form a turbine front section and a turbine end section, respectively, each of which are useable in turbines using different rotational speeds and the middle section is configured to form a turbine middle section for a predetermined rotational speed to adapt each turbine to a specified power grid frequency.

9. A method of manufacturing a casing for a turbine configured to provide power to a power grid, the method comprising:

forming a front mold section configured to form a turbine front section;

forming a middle mold section configured to form a turbine middle section;

forming an end mold section configured to form a turbine end section wherein the turbine front section and the turbine end section are useable in turbines using different rotational speeds and the turbine middle section is useable in turbines using a predetermined rotational speed, to adapt the turbine to a specified power grid frequency;

assembling at least the front mold section, the middle mold section and the an end mold section; and casting the turbine using the assembled molds.

* * * * *